US008595883B1

(12) United States Patent
Kern

(10) Patent No.: US 8,595,883 B1
(45) Date of Patent: Dec. 3, 2013

(54) PAINT BRUSH WITH PERPENDICULAR HANDLE AND INTERCHANGEABLE BRUSH HEADS

(76) Inventor: John Kern, Fremont, OH (US)

( * ) Notice: Subject to any disclaimer, the term of this patent is extended or adjusted under 35 U.S.C. 154(b) by 1352 days.

(21) Appl. No.: 11/524,632

(22) Filed: Sep. 21, 2006

Related U.S. Application Data

(60) Provisional application No. 60/719,877, filed on Sep. 24, 2005.

(51) Int. Cl.
*A47L 13/00* (2006.01)

(52) U.S. Cl.
USPC ..... 15/143.1; 15/145; 15/176.1; 15/176.6; 4/134

(58) Field of Classification Search
USPC ..... 15/143.1, 144.2, 145, 172, 176.1, 15/176.2, 176.4, 176.5, 176.6, 184, 202; D4/134
See application file for complete search history.

(56) References Cited

U.S. PATENT DOCUMENTS

| | | | | | |
|---|---|---|---|---|---|
| 2,395,245 | A * | 2/1946 | Booharin | 15/144.2 |
| 3,604,044 | A * | 9/1971 | Johnson | 15/172 |
| 4,209,027 | A * | 6/1980 | Morganroth | 132/212 |
| 5,570,487 | A * | 11/1996 | Schneider | 15/167.1 |
| 5,749,117 | A * | 5/1998 | Forsline | 15/245.1 |
| 5,802,658 | A * | 9/1998 | Ward | 15/144.2 |
| 5,991,956 | A * | 11/1999 | Chapman | 15/146 |
| 6,148,467 | A * | 11/2000 | Martinsson | 15/172 |
| D448,934 | S * | 10/2001 | Barnette et al. | D4/121 |
| 6,487,748 | B1 * | 12/2002 | Dardar et al. | 15/167.1 |
| 2002/0004963 | A1 * | 1/2002 | Woodnorth et al. | 15/160 |
| 2005/0198759 | A1 * | 9/2005 | Segrea | 15/176.1 |

* cited by examiner

*Primary Examiner* — Eileen P. Morgan
(74) *Attorney, Agent, or Firm* — Jerry Semer

(57) ABSTRACT

The invention is a paint brush with the handle perpendicular to the brushes bristles. The brush is made up of a handle section, a brush head holder section and a brush head section. The brush head section and the bush head holder section is attached to the handle such that the handle is perpendicular to the bristles of the brush head section. The brush head section is releasably attached to the brush head section. This enables several different brush head section of differing sizes to be placed on the same handle.

13 Claims, 7 Drawing Sheets

18
16
12
10

20

PAINT BRUSH WITH PERPENDICULAR HANDLE AND INTERCHANGEABLE BRUSH HEADS

This application is a continuation-in-part of prior application No. 60/719,877 that was filed on Sep. 24, 2005.

FIELD OF INVENTION

This invention relates to the field of paint brushes and more particularly to the field of paint brushes with interchangeable brush heads.

BACKGROUND OF THE INVENTION

In order to use a paint brush one has to move his wrist as he moves up and down or from side to side with the brush. If a person is employed as a painter he has to make this motion day in and day out. This will ultimately lead to the painter getting a repetitive stress injury or carpal tunnel syndrome and painting will cause him a great deal of pain.

Also, for older painters who have arthritis within their wrists, painting is painful. The inventor has designed a brush will greatly reduce these problems. Thus, the first objective of this invention is to create a brush which an individual can use without the normal up and down movement or side to side movement of the wrist. The feature that enables the inventor's brush to be used without movement of the wrist is that the inventor has moved the handle so that the handle would be ninety degrees or perpendicular to the brush head. This also enables the painter to grab the brush in a normal grip. He can now use the brush without movement of his wrist. The applicant has further made the brush handle slightly curved and shaped so that an individual can hold the brush in a normal grip.

Another problem of the brushes presently out on the market is that the brush head wears out far earlier than the handle of the brush. The brush head can wear out for several reasons. The first being that the brush was not properly cared for thus the paint for varnish or shellac has dried within the brush making it unusable. Brush heads also wear out from normal use. In both of these cases the brush head will wear out long before the handle wears out.

Thus, one of the objectives of this invention is to create a method of removing a brush head from the handle and replacing it with another. Applicant has developed a method for interchangeable brush heads so if the first one wears out one has another one to put in its place. This also enables the individual to place brush heads of different sizes on the brush. Thus, one handle can be used for a one inch brush as well as a three inch brush head. Like being able to take the brush head off the handle, it allows for easier clean up of the brush head and also for easier storage of the brush head in that the brush heads can easily be dropped into a plastic bag, especially when using water soluble paints.

SUMMARY OF THE INVENTION

The invention is a paint brush with the interchangeable brush heads. The brush is made up of a handle section, a brush head holder section and a brush head section. In one embodiment the brush head section and the bush head holder section is attached to the handle such that the handle is nearly perpendicular to the bristles of the brush head section. The brush head section is releasably attached to the brush head section.

This enables several different brush head section of differing sizes to be placed on the same handle.

DETAILED DESCRIPTION OF THE PREFERRED EMBODIMENT

Figure 1:
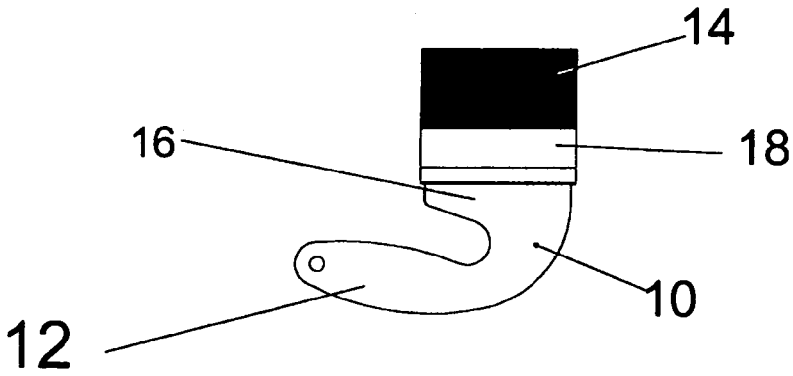
FIG. 1 is a side view of the invention.
Figures 2A, 2B, 2C, 2D, 2E:
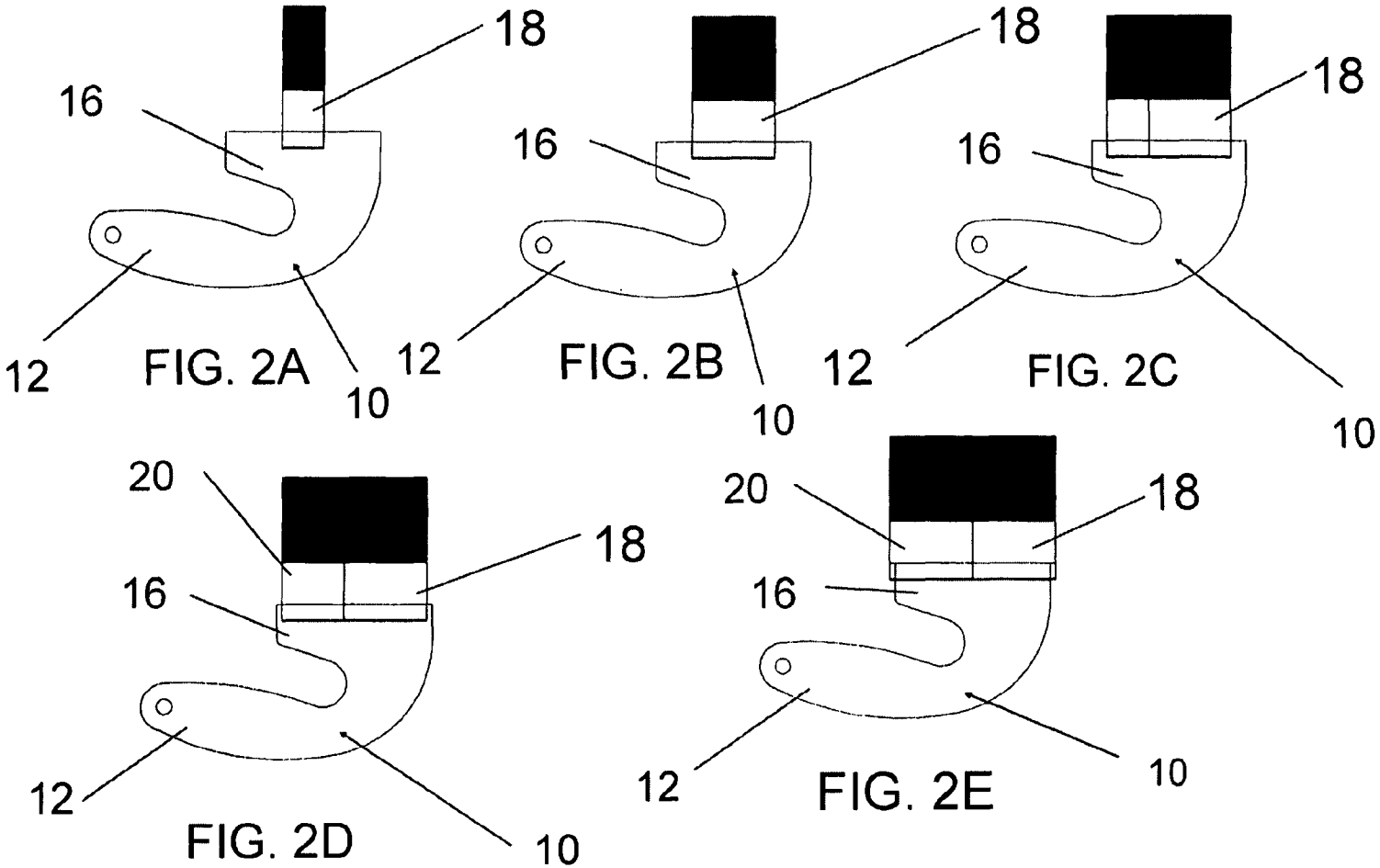
FIG. 2A is a side view of the invention with a small brush head.
FIG. 2B is a side view of the invention with a different size brush head from FIGS. 1 and 2A.
FIG. 2C is a side view of the invention with two brush heads of differing sizes.
FIG. 2D is a side view of the invention two brush heads different form FIG. 2C of differing sizes.
FIG. 2E is a side view of the invention with two brush heads of the same size.

FIG. 1 is a side view of the invention. FIG. 1 shows a paint brush 10 that has a handle 12 perpendicular to the strands 14 of the paint brush 10. The handle 12 does not have to be exactly perpendicular to the strands 14 of the paint brush 10. In fact it could vary up to 45 degrees either way from perpendicular. The inventor has found, however, that the closer to perpendicular the brush is the more painters like it. In FIG. 1 the handle 12 is of sufficient size that a person can grip it easily. The brush holder portion 16 of the paint brush 10 is nearly perpendicular to this handle 12. The brush holder portion 16 of the invention is designed and manufactured exactly as the brush portions of paint brushes presently in the market place.

FIG. 2A, 2B, 2C, 2D, and 2E show another embodiment of the invention. In this invention the handle 12 is also perpendicular to the brush strands 14. This handle 12, like the previous embodiment, is of the size that an individual can grip easily. The brush holder portion 16 has one or more brush heads 18. These brush heads 18 are interchangeable. Brush head 18 in FIG. 2A, 2B, 2C, 2D, and 2E can be removed from the paint brush 10 and be replaced with another brush head 18. In this embodiment there are two brush heads in FIGS. 2C, 2D, and 2E, 18 and 20, which have been placed on the brush 2D, and 2E brush holder portion 16 of the paint brush 10. In the preferred embodiment the brush holder portion 16 is four inches wide and in FIGS. 2C, 2D, and 2E holds two brush heads 18 and 20. These brushes can vary in width. The brush holder portion 16 of the paint brush 10 can be made to any width as a normal paint brush. Although the brush holder portion 16 in the preferred embodiment is four inches wide, brushes of many sizes can be placed upon it. Also, as in FIG. 2A, 2B, 2C, 2D, or 2E, two or more different brush heads 18 can also be placed on it.

Figure 3:
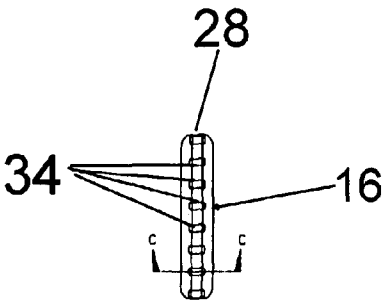
FIG. 3 is a top view of the brush holder section.
Figure 4:
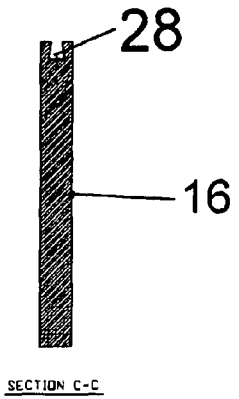
FIG. 4 is a section view along line c-c of FIG. 3.
Figure 5:
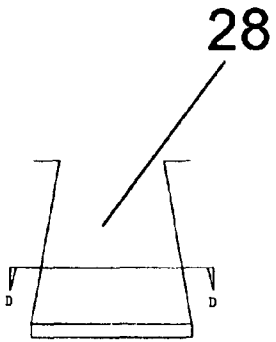
FIG. 5 is an end view the dove tail grove.
Figure 5A:
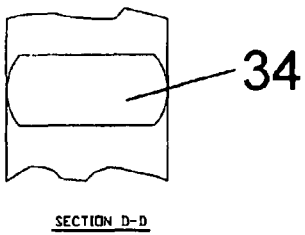
FIG. 5A is a section view along line d-d of FIG. 5.

FIG. 3 is a top view of the brush holder portion 16 of the embodiment of FIG. 1, 2A, 2B, 2C, 2D, or 2E. FIG. 3 shows grooves 34 on the top of paint brush holder section 16 of paint brush 10. These grooves 34 are placed on the bottom of dove tailed groove 28 which is shown in FIG. 4 which is section c-c of FIG. 3. FIG. 5 shows the shape of the dove tailed groove 28 which is placed on the top of the paint brush holder section 16. FIG. 5A is a sectional view along line d-d of FIG. 5 showing groove 34 which are placed on the bottom of the dove tailed groove 28 as shown in FIG. 3. The dove tailed groove 28 is designed to allow the paint brush heads 18 fit within.

Figures 6, 6A:
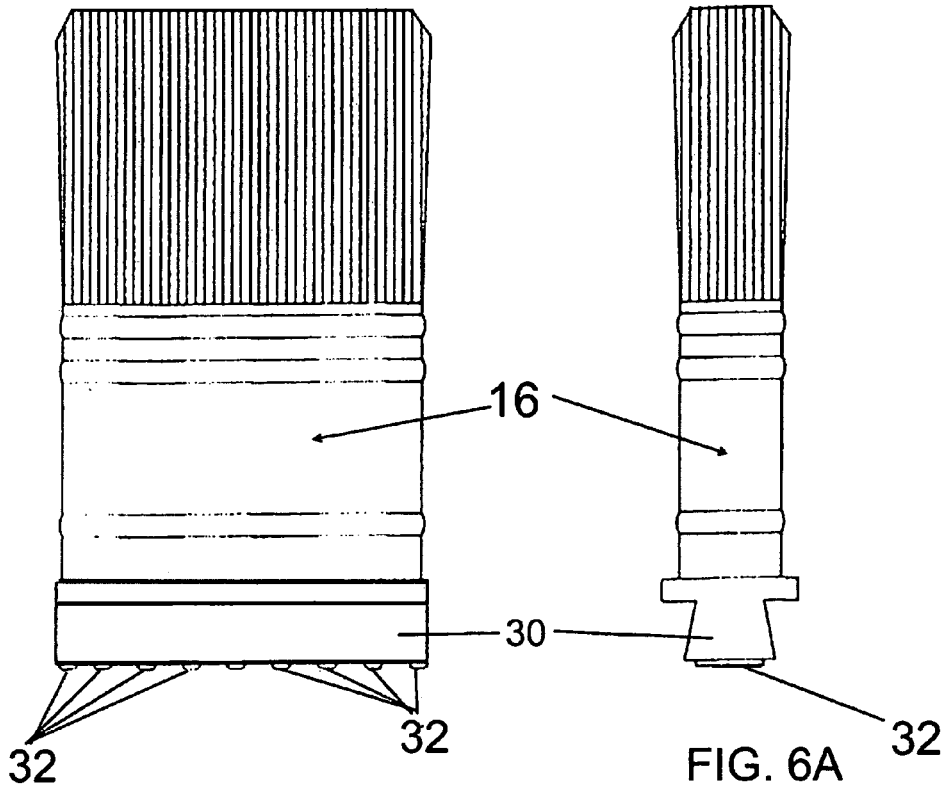
FIG. 6 is a side view of the brush head.
FIG. 6A is an end view of the brush head.

FIG. 6 is a side view of the brush head 18. FIG. 6A is a end view of the brush head 18. The end view 6A shows that the bottom of the brush head 18 has a dove tail extension 30. This dove tail extension 30 fits within the dove tail groove 28 at the top of the brush holder portion 16.

FIG. 6B shows that at the bottom of the paint brush head 18 on its dove tail extension 30 are a set of bumps 32. These bumps 32 are designed to fit within the grooves 34 shown in FIGS. 3 and 5A. The paint brush head 18 of paint brush 10 has bumps 32 which fit within the groves 34 of paint brush holder 16. One can also see the grooves 34 in FIGS. 3 and 5A. The dove tail extension 30 and bumps 32 and the dove tail groove 28 and the grooves 34 hold the paint brush head 18 securely in place so it doesn't move while an individual is using it to paint.

Figures 7, 7A, 7B, 7C, 7D:
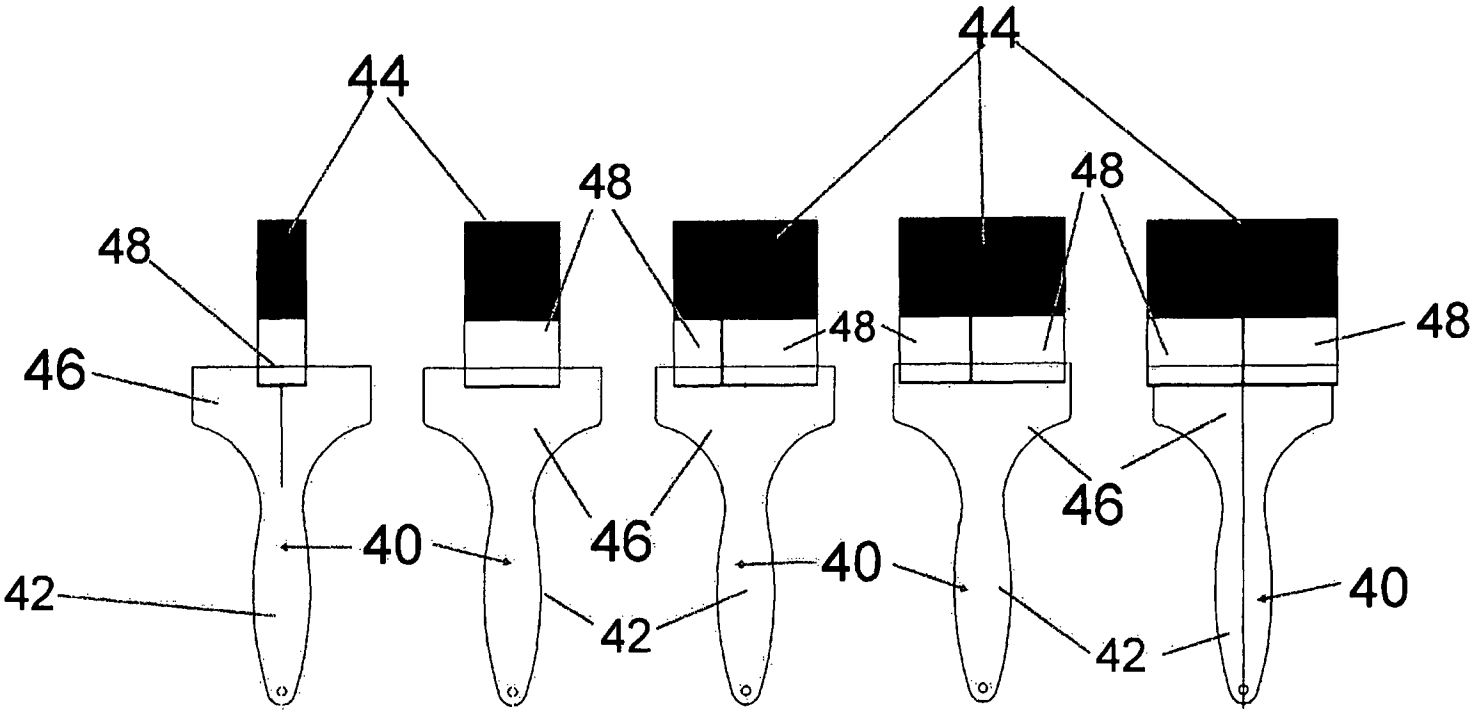
FIG. 7 is a side view of another embodiment of the invention.
FIG. 7A is a side view of another embodiment of the invention with a different size of brush head.
FIG. 7B is a side view of another embodiment of the invention with two brush heads of differing sizes.
FIG. 7C is a side view of another embodiment of the invention with two brush heads of differing sizes whose size are different from FIG. 7B.
FIG. 7D is a side view of another embodiment of the invention with two brush heads of the same size.

FIGS. 7, 7A, 7B, 7C, and 7D shows another embodiment of the invention. In FIGS. 7, 7A, 7B, 7C, and 7D the paint brush 40 looks very similar to the paint brushes now on the market. FIG. 7 shows a paint brush 40 whose handle 42 is in line with the strands 44 of the paint brush 40. This paint brush, however, has the same three parts as the paint brush 10 of the previous embodiment. Paint brush 40 has a handle 42, a brush holder section 46, and a brush head 48. The brush holder section 46 has 1 or more brush heads 48 that can be placed up on the brush holder section 46. In FIGS. 7, 7A, 7B, 7C, and 7D the brush head 48 is interchangeable with other brush heads 48. In this embodiment the brush holder section 46 and the brush head 48 attach together just as in the previous embodiment. The brush heads 48 for this embodiment are designed similarly to the brush heads 18 for the previous embodiment. Brush heads 18 and 48 could be interchangeable. The width of the brush holder section 46 can be made large enough so that more than one brush head could actually be placed on the holder. Thus, an individual could use, say two, two inch brush heads 48 if the brush head holder 48 width was four inches, or he could use one four inch brush head.

Figure 8:
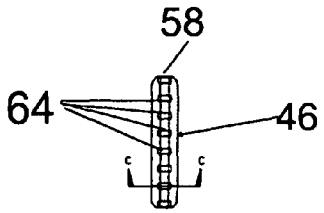
FIG. 8 is a top view of the other embodiment of the invention of the brush holder section.
Figure 8A:
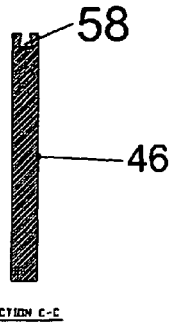
FIG. 8A is a section view along line c-c of FIG. 8.
Figure 8B:
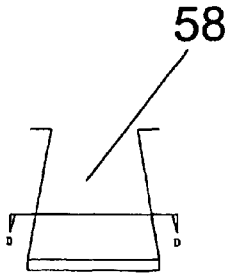
FIG. 8B is an end view the dove tail grove of the other embodiment of the invention.
Figure 8C:
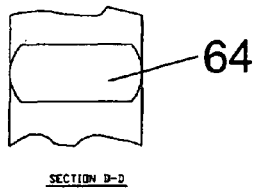
FIG. 8C is a section view along line d-d of FIG. 8B.

FIG. 8 shows a top view of the brush holder section 46 of the paint brush 40. In FIG. 8 one sees that the paint brush holder section 46 has a dove tail groove 58 at its top. This dove tail groove 58 is designed to allow the paint brush head 48 shown in FIGS. 9 and 9A to fit within. FIG. 8 shows grooves 64 on the top of paint brush holder section 46 of paint brush 10. These grooves 64 are placed on the bottom of dove tailed groove 58 which is shown in FIG. 8A which is section c-c of FIG. 8. FIG. 8B shows the shape of the dove tailed groove 58 which is placed on the top of the paint brush holder section 46. FIG. 8C is a sectional view along line d-d of FIG. 8B showing groove 64 which are placed on the bottom of the dove tailed groove 58 as shown in FIG. 8A. This dove tail groove 58 is designed to allow the paint brush head 48 shown in FIGS. 9 and 9A to fit within.

Figures 9, 9A:
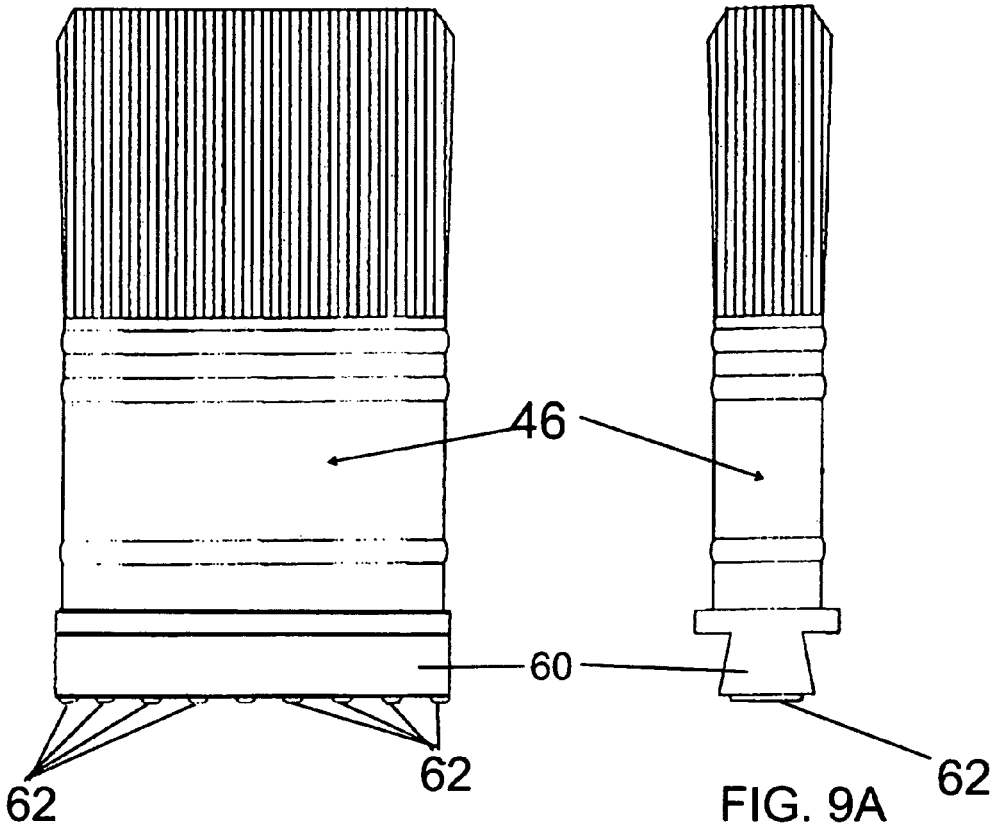
FIG. 9 is a side view of the brush head of the other embodiment of the invention.
FIG. 9A is an end view of the brush head of the other embodiment of the invention.

FIG. 9 is a side views the paint brush head 48. FIG. 9A is an end view of the paint brush head 48. The end view of FIG. 9A shows that the bottom of the paint brush head 48 has a dove tail extension 60. This dove tail extension 60 fits within the dove tail groove 58 at the top of the paint brush holder section 46. On its dove tail extension 60 are a set of bumps 62. These bumps 62 are designed to fit within grooves 64 shown in FIGS. 8 and 8C. The paint brush head 48 has bumps 62 which fit within grooves 64 of the paint brush holder section 46. One can see the grooves 64 in the top view 8 paint brush holder section 46. The dove tail extension 60 and bumps 362 and the dove tail groove 58 and the grooves 64 hold the paint brush holder section 46 securely in place so it doesn't move while an individual is using it to paint.

Changes and modifications in the specifically described embodiments can be carried out without departing from the scope of the invention which is intended to be limited only by the scope of the appending claims.

I claim:

1. A paint brush comprising:

a. a brush head section that contains bristles and a means for holding those bristles in place for painting with a top and a bottom and said bristles extend from the top of the means for holding the bristles in place; and, b. a rectangular midsection with a top and bottom and of approximately the same width as the brush head section and the top of the rectangular midsection attaches to the bottom of the brush head section; and, c. a handle with a top and bottom that is adapted such that an individual can grasp the handle for painting and the handle's top is attached to the bottom of the midsection; and, c. the brush head section and the handle extending from opposite sides of the midsection; and, d. the brush head section can be removed and reattached to the midsection; and, e. the brush head section has a dove tail extension from its bottom; and, f. the midsection has a dove tail on its top that is adapted to fit within the dove tail extension of the brush head section; and, g. the dove tail extension has bumps on its bottom and the dove tail has grooves on its bottom in which the bumps on the bottom of the dove tail extension fit within the groves on the bottom of the dove tail to ensure that the paint brush head is held securely in place upon the midsection and will not move while an individual is painting with the paint brush; and, h. said brush head section, midsection and said handle all lying in the same plane.

2. A paint brush as in claim 1 wherein:

a. more than one brush head section can be attached to the midsection.

3. A paint brush as in claim 1 wherein:

a. the brush head section comes in many different sizes.

4. A paint brush as in claim 1 wherein:

a. more than one brush head section can be attached to the midsection at the same time.

5. A paint brush as in claim 3 wherein:

a. more than one brush head section can be attached to the midsection at the same time.

6. A paint brush comprising:

a. a brush head section that contains bristles and a means for holding those bristles in place for painting with a top and a bottom and said bristles extend from the top of the means for holding the bristles in place; and, b. a rectangular midsection of approximately the same length as the brush head section attached to the bottom of the means for holding the bristles in place; and, c. a handle that is adapted such that an individual can grasp; and, d. the brush head section and the handle extending from opposite sides of the midsection; and, e. the handle is attached to the midsection such that the handle is in the same plane as the bristles of the brush and the midsection and the handle extends from the bottom of the midsection and then curves approximately perpendicular to the bristles of the brush head section and the midsection.

7. A paint brush as in claim 6 wherein:

a. the brush head section is releasably attached to the midsection.

8. A paint brush as in claim 6 wherein:

a. more than one brush head section can be attached to the midsection at the same time.

9. A paint brush holder as in claim 6 whereas a. the brush head comes in many different sizes.

10. A paint brush as in claim 6 wherein:

a. the brush head is attached to the midsection releasably by an interlocking method.

11. A paint brush as in claim 10 wherein:

a. the brush head and the midsection are attach together by a dove tail interlocking system.

12. A paint brush as in claim 11 wherein:

a. the brush head section has a dove tail extension from its bottom; and, b. the midsection has a dove tail on its top that is adapted to fit within the dove tail extension of the brush head section.

13. A paint brush as in claim 11 wherein:

a. the dove tail extension has bumps on its bottom and the dove tail has grooves on its bottom in which the bumps on the bottom of the dove tail extension fit within the groves on the bottom of the dove tail to ensure that the paint brush head is held securely in place upon the midsection and will not move while an individual is painting with the paint brush.

* * * * *